US007934821B2

(12) United States Patent
Hattori

(10) Patent No.: US 7,934,821 B2
(45) Date of Patent: May 3, 2011

(54) INK CARTRIDGES AND INK SUPPLY SYSTEMS

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 410 days.

(21) Appl. No.: 12/174,919

(22) Filed: Jul. 17, 2008

(65) Prior Publication Data

US 2009/0021565 A1 Jan. 22, 2009

(30) Foreign Application Priority Data

Jul. 17, 2007 (JP) ..... 2007-185463

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS

| | | | | |
|---|---|---|---|---|
| 6,435,673 | B1 * | 8/2002 | Hattori et al. | 347/86 |
| 6,585,361 | B1 * | 7/2003 | Jones | 347/86 |
| 7,517,069 | B2 * | 4/2009 | Sasaki et al. | 347/86 |
| 2007/0070137 | A1 | 3/2007 | Hattori et al. | |

FOREIGN PATENT DOCUMENTS

| | | | |
|---|---|---|---|
| JP | 63013749 | A | 1/1988 |
| JP | 200790733 | A | 4/2007 |

* cited by examiner

*Primary Examiner* — An H Do
(74) *Attorney, Agent, or Firm* — Baker Botts L.L.P.

(57) ABSTRACT

An ink cartridge includes an ink storing portion configured to store ink therein and a particular wall defining a portion of the ink storing portion. The particular wall has a particular passage formed therethrough. The ink cartridge also includes a pipe extending from an interior of the ink storing portion to an exterior of the ink storing portion via the particular passage. The pipe has an inner passage formed therethrough, and the inner passage is configured to transmit ink from the interior of the ink storing portion to the exterior of the ink storing portion.

7 Claims, 7 Drawing Sheets

INK CARTRIDGES AND INK SUPPLY SYSTEMS

CROSS-REFERENCE TO RELATED APPLICATION

The present application claims priority from Japanese Patent Application No. JP-2007-185463, which was filed on Jul. 17, 2007, the disclosure of which is incorporated herein by reference in its entirety.

BACKGROUND OF THE INVENTION

1. Field of the Invention

The present invention relates generally to ink cartridges and ink supply systems for use with a recording apparatus, such as an inkjet printer.

2. Description of Related Art

A known ink cartridge, such as the ink cartridges described in Japanese Patent Application Publication Nos. JP-A-2007-90733 and JP-A-63-13749, respectively, is configured to be removably mounted to a known inkjet printer. The known inkjet printer includes a recording head, and the known ink cartridge includes an ink chamber and an ink supply portion. When the ink cartridge is mounted to the inkjet printer, ink is supplied from the ink chamber to the recording head via the ink supply portion. The ink cartridge includes a valve mechanism configured to prevent ink from leaking from the ink chamber via the ink supply portion when the ink cartridge is not mounted to the inkjet printer.

The known ink cartridge has a particular wall having an opening formed therethrough, and the ink supply portion of the ink cartridge includes a valve body configured to selectively cover and uncover the opening. The ink supply portion also includes a coil spring configured to apply a biasing force to the valve body in a direction in which the valve body covers the opening, and a sealing member positioned in the opening at a position adjacent to the exterior of the ink cartridge. The sealing member has an inner opening formed therethrough. The known inkjet printer includes a cartridge mounting portion in which a pipe is positioned. The cartridge mounting portion has an open end and a closed end opposite the open end. The ink cartridge is configured to be inserted into the cartridge mounting portion in an insertion direction. The pipe extends from the closed end toward the open end in a direction which is opposite to the insertion direction. When the ink cartridge is mounted to the cartridge mounting portion, the pipe enters the opening of the particular wall via the inner opening of the sealing member, and the sealing member seals a gap between the opening of the particular wall and the pipe. When the pipe contacts and applies a force to the valve body against the biasing force of the coil spring, the valve body moves away from the opening of the particular wall, such that the opening of the particular wall is uncovered. Ink then is supplied from the ink chamber to the recording head via the opening of the particular wall and the pipe.

Nevertheless, because the pipe extends in the direction which is opposite to the insertion direction, when the ink cartridge is not correctly inserted into the cartridge mounting portion, e.g., when the ink cartridge is inserted into the cartridge mounting portion up side down, or if the ink cartridge is inserted into the cartridge mounting portion with the particular wall not facing the closed end of the cartridge mounting portion, the pipe contacts the outer surface of the ink cartridge. Consequently, the pipe may be damaged, e.g., broken. When the pipe is damaged, ink no longer may be able to be supplied to the recording head. Because the user may not be able to fix the damaged pipe, the user may have to have the manufacturer of the inkjet printer fix the damaged pipe. While the manufacturer is fixing the damaged pipe, the user is not able to use the printer.

Moreover, until the pipe contacts the valve body after the pipe enters the opening of particular wall, the pipe pushes away air and/or ink disposed in the opening of particular wall. Such air and/or ink enters the interior of the pipe, and compresses ink disposed in a path of ink extending from the pipe to the recording head, such that the pressure in the path of ink increases. The increased pressure may affect menisci of ink within the nozzles of the recording head, and ink may leak from the nozzles. This may deteriorate the quality of an image recorded on a recording medium.

SUMMARY OF THE INVENTION

Therefore, a need has arisen for ink cartridges and ink supply systems which overcome these and other shortcomings of the related art. A technical advantage of the present invention is that a pipe of a recording apparatus may not be damaged when the ink cartridge is not correctly inserted into a cartridge mounting portion of the recording apparatus.

According to an embodiment of the present invention, an ink cartridge comprises an ink storing portion configured to store ink therein, and a particular wall defining at least a portion of the ink storing portion. The particular wall has a particular passage formed therethrough. The ink cartridge also comprises a pipe extending from an interior of the ink storing portion to an exterior of the ink storing portion via the particular passage. The pipe has an inner passage formed therethrough, and the inner passage is configured to transmit ink from the interior of the ink storing portion to the exterior of the ink storing portion.

According to another embodiment of the present invention, an ink cartridge comprises an ink storing portion configured to store ink therein, and a particular wall defining at least a portion of the ink storing portion. The particular wall has a particular passage formed therethrough. The ink cartridge also comprises a pipe extending from the particular wall away from the ink storing portion. The pipe has an inner passage formed therethrough, and the inner passage is continuous with the particular passage. The particular passage and the inner passage are configured to transmit ink from the interior of the ink storing portion to an exterior of the ink storing portion. Moreover, the ink cartridge comprises an absorbing member configured to absorb ink, wherein the absorbing member is positioned within the ink storing portion and adjacent to the particular passage.

According to yet another embodiment of the present invention, an ink supply system comprises a connecting portion configured to be in fluid communication with the recording head, and an ink cartridge. The ink cartridge comprises an ink storing portion configured to store ink therein. The ink storing portion comprises an ink chamber configured to store a first predetermined amount of the ink therein, and a valve chamber configured to store a second predetermined amount of ink therein, which is less than the first predetermined amount of ink. The ink cartridge also comprises a particular wall defining at least a portion of the valve chamber, and the particular wall has a particular passage formed therethrough. Moreover, the ink cartridge comprises a valve body comprising a moving body positioned within the valve chamber, and a pipe extending from the moving body. The pipe extends from an interior of the valve chamber to an exterior of the ink cartridge via the particular passage, and the pipe is configured to be removably connected to the connecting portion. The pipe has an inner passage formed therethrough, and ink is supplied from the interior of the valve chamber to the connecting portion via the inner passage of the pipe when the pipe is connected to the connecting portion. Moreover, the pipe has an outer periphery and a further passage formed therein, and the further passage extends from the outer periphery to the inner passage. In addition, the valve body is configured to move between a first position in which the particular passage is positioned between the further passage and the valve chamber, and a second position in which the further passage is positioned within the valve chamber. The ink supply system also comprises a biasing member configured to apply a biasing force to the moving body to position the moving body in the first position, and the valve body is configured to move from the first position to the second position against the biasing force when the pipe is connected to the connecting portion.

According to still another embodiment of the present invention, an ink supply system comprises an ink cartridge. The ink cartridge comprises an ink storing portion configured to store ink therein, and a particular wall defining at least a portion of the ink storing portion. The particular wall has a particular passage formed therethrough. The ink cartridge also comprises a pipe extending from the particular wall away from the ink storing portion, and the pipe has an inner passage formed therethrough, and the inner passage is continuous with the particular passage. The ink supply system also comprises a connecting portion configured to be in fluid communication with the recording head, and the pipe is configured to be removably connected to the connecting portion. The connecting portion comprises a further wall defining at least a portion of a space therein. The further wall has a further passage formed therethrough. The connecting portion also comprises a valve body which positioned in the space and is configured to move between a first position in which the valve body covers the further passage and a second position in which the valve body is separated from the further passage. Moreover, the connecting portion comprises a biasing member configured to apply a biasing force to the valve body to position the valve body in the first position. The valve body is configured to move from the first position to the second position against the biasing force when the pipe is connected to the connecting portion to supply ink from an interior of the ink storing portion to the connecting portion.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-7, like numerals being used for like corresponding portions in the various drawings.

Figure 1:
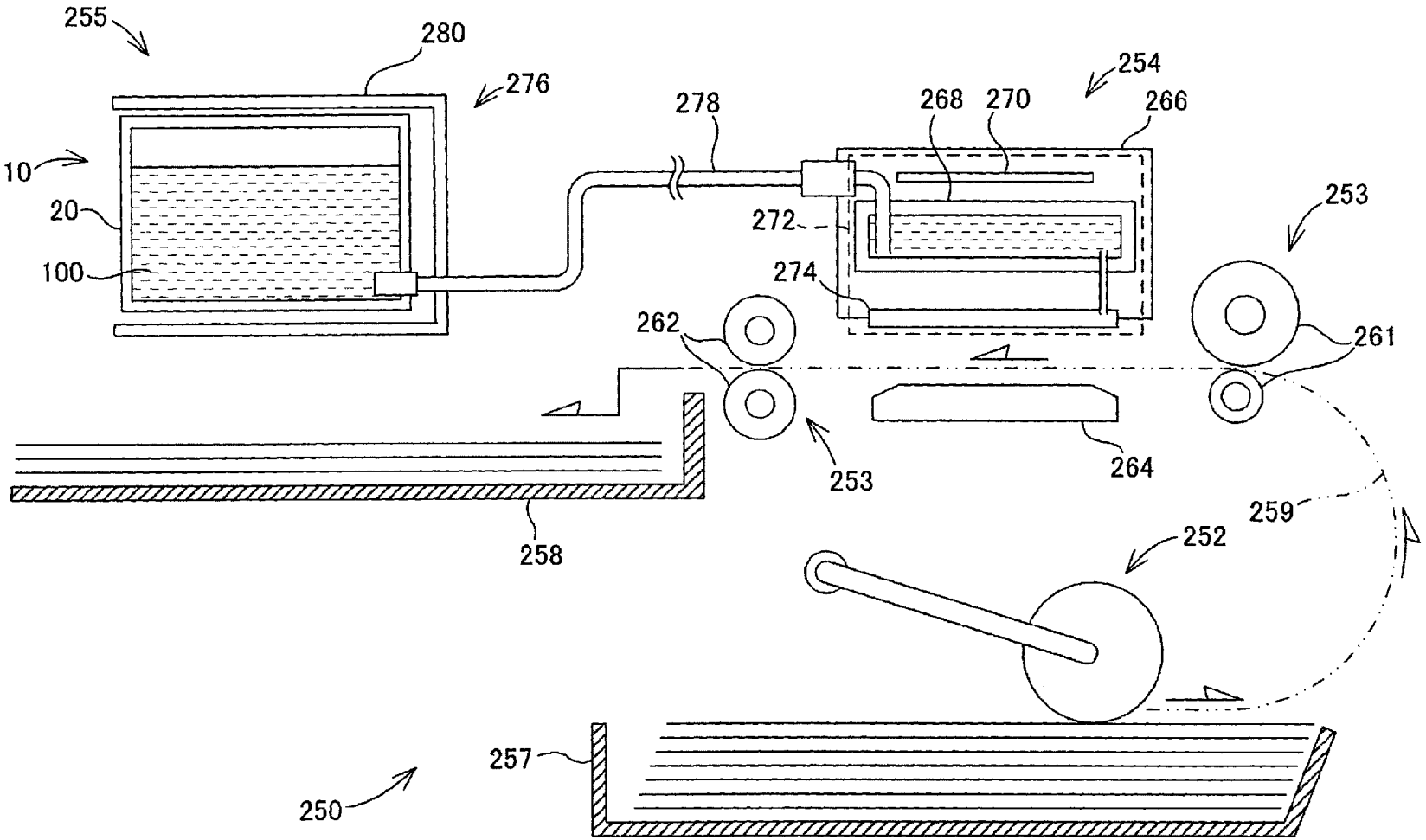
FIG. 1 is a cross-sectional, pattern diagram of a recording apparatus, according to an embodiment of the present invention.

Referring to FIG. 1, an inkjet recording apparatus 250 according to an embodiment of the invention is depicted. Recording apparatus 250 may be configured to record an image, e.g., a monochrome image or color image, on a recording medium, e.g., a sheet of paper, with at least one ink, e.g., four different colored inks, such as a black ink, a yellow ink, a cyan ink, and a magenta ink. Recording apparatus 250 may comprise a feeding device 252, a transferring device 253, a recording device 254, and an ink supply system 255. Recording apparatus 250 also may comprise a first tray 257 and a second tray 258, and recording apparatus 250 may have a transfer path 259 extending from first tray 257 to second tray 258. Feeding device 252 may be configured to feed sheets of paper accommodated in first tray 257, one by one, to transfer path 259.

Transferring device 253 may comprise a first pair of transfer rollers 261 and a second pair of transfer rollers 262 positioned along transfer path 259. First pair of transfer rollers 261 may be positioned on the upstream side of recording device 254, and second pair of transfer rollers 262 may be positioned on the downstream side of recording device 254 along transfer path 259.

Recording apparatus 250 also may comprise a platen 264 positioned directly below recording device 254. The sheet of paper fed by feeding device 252 may be transferred onto platen 264 by first pair of transfer rollers 261. Recording device 254 may be configured to record an image on the sheet of paper being transferred over platen 264. A sheet of paper which passes over platen 264 may be transferred by second pair of transfer rollers 262 to second tray 258, which is positioned at the downstream end of transfer path 259.

Recording device 254 may comprise a carriage 266, and a recording head 272 mounted in carriage 266. Recording head 272 may have a plurality of nozzles 274 formed therein, and may comprise at least one, e.g., four, sub-tanks 268, and a head controlling board 270. Carriage 266 may be supported by rails (not shown), such that carriage 266 may slide on the rails in a direction perpendicular to the paper plane of FIG. 1.

Sub-tanks 268 each may be configured to store ink therein, which is to be supplied to nozzles 274. For example, each of sub-tanks 268 may store a different color ink. When a signal is inputted to head controlling board 270, head controlling board 270 may control recoding head 272 based on the inputted signal, such that ink is ejected through nozzles 274 onto the sheet of paper.

Ink supply system 255 may comprise a cartridge mounting portion 276 and at least one, e.g., four, ink cartridges 10 storing at least one kind of ink, e.g., four kinds of inks, such as a black ink, a yellow ink, a cyan ink, and a magenta ink, respectively. Cartridge mounting portion 276 may be configured to receive at least one ink cartridge 10, such that at least one ink cartridge 10 may be mounted on cartridge mounting portion 276. Cartridge mounting portion 276 may comprise a plurality of, e.g., four, cases 280 corresponding to four ink cartridges 10, respectively. Ink cartridge 10 may be configured to be selectively inserted into and removed from case 280. Recording apparatus 250 may comprise at least one flexible tube 278, e.g., four flexible tubes 278, connected to at least one of sub-tanks 268 and to at least one of cases 280, respectively. When ink cartridge 10 is mounted to cartridge mounting portion 276, ink may be supplied from ink cartridge 10 to a corresponding one of sub-tanks 268 via a corresponding one of tubes 278.

Figure 2B:
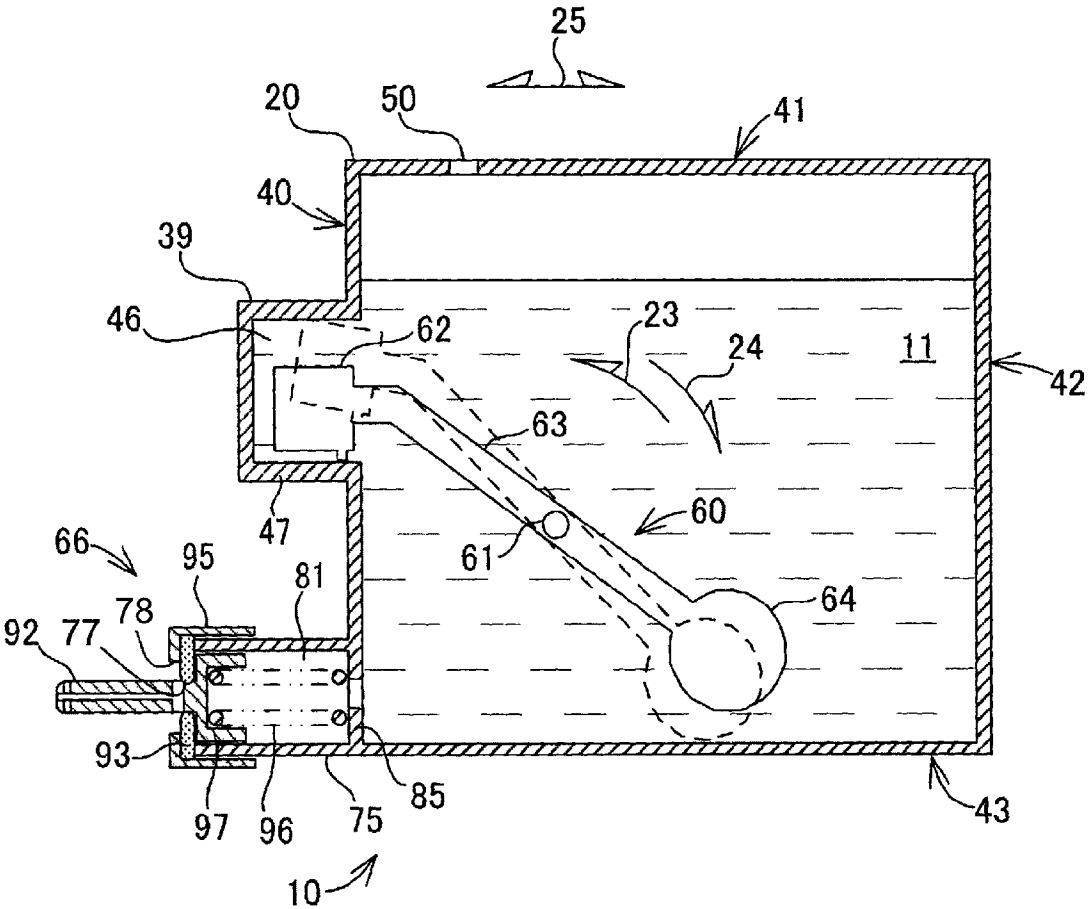
FIG. 2(B) is cross-sectional, side view of the ink cartridge of FIG. 2(A).
Figure 2A:
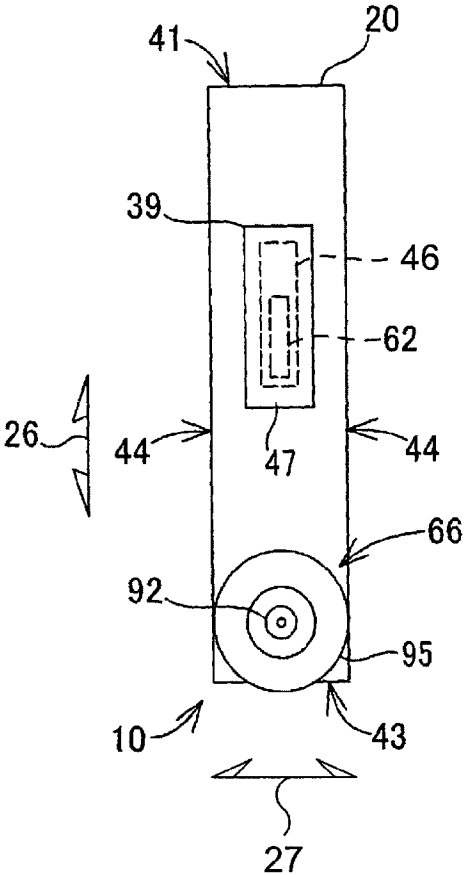
FIG. 2(A) is a front view of an ink cartridge, according to an embodiment of the present invention.
Figure 3:
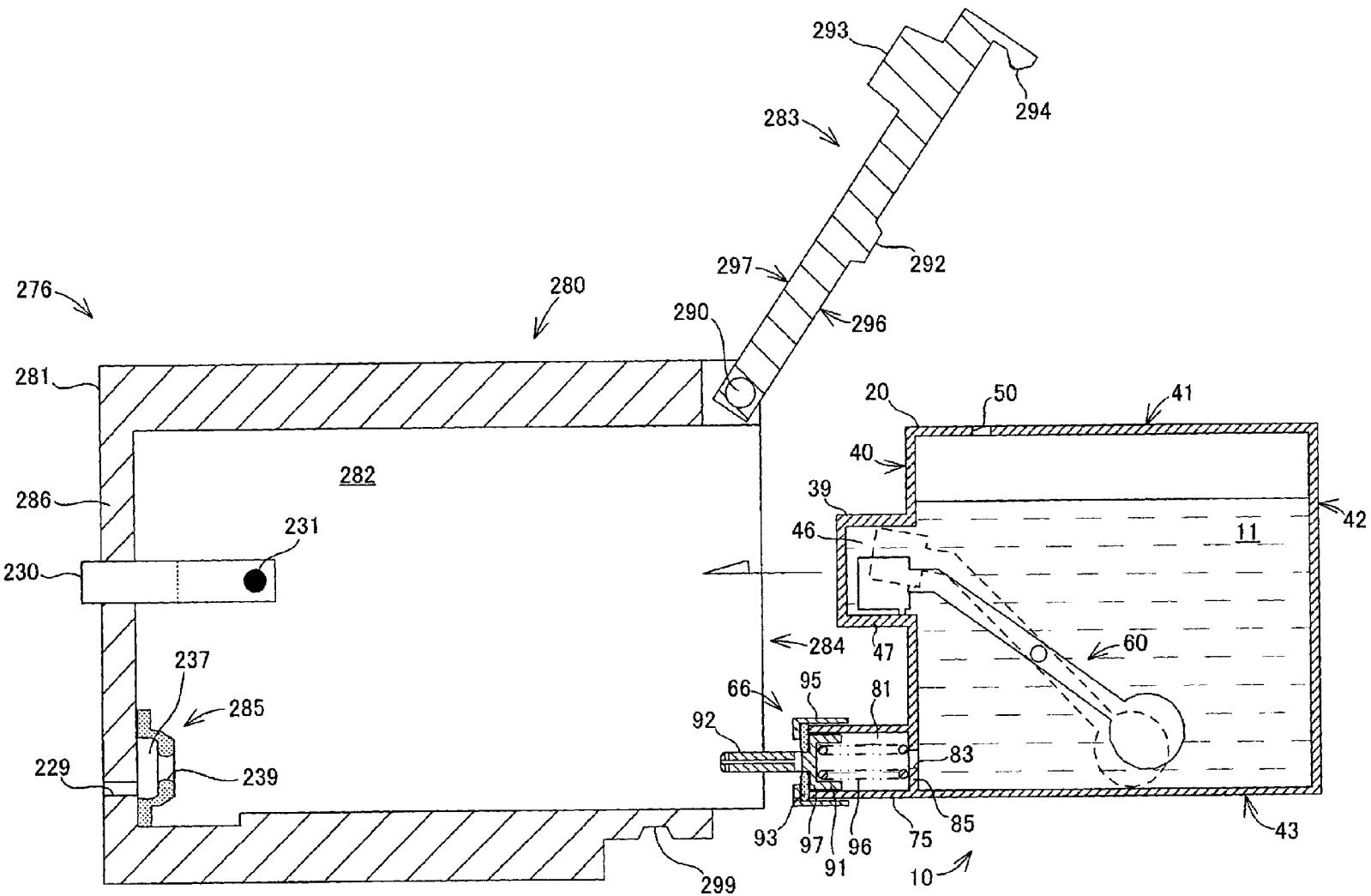
FIG. 3 is a cross-sectional, side view of a cartridge mounting portion of the recording apparatus of FIG. 1 and the ink cartridge of FIGS. 2(A) and (B), in which the ink cartridge is positioned outside of a case of the cartridge mounting portion, according to an embodiment of the present invention.

Referring to FIGS. 2(A) and 2(B), ink cartridge 10 may have a substantially flat, hexahedron shape. In an embodiment, a width of ink cartridge 10 in a width direction, as indicated by an arrow 27, is relatively short, a height of ink cartridge 10 in a height direction, as indicated by an arrow 26, is greater than the width of ink cartridge 10, and a depth of ink cartridge 10 in a depth direction, as indicated by an arrow 25, is greater than the height of ink cartridge 10. Ink cartridge 10 may comprise case 20, a pivotable member 60, and a valve mechanism 66. Case 20 may comprise a detection portion 39. Ink cartridge 1 may comprise an ink chamber 11 formed in case 20, and a valve chamber 81. Moreover, an ink storing portion may comprise ink chamber 11 or valve chamber 81, or both, and may be configured to store ink therein.

Case 20 may comprise a translucent resin material, e.g., a transparent resin material or a semi-transparent resin material, such as polyethylene, acrylonitrile butadiene styrene, or combination thereof, such that light may pass through case 20. Case 20 may be substantially a box shape, and may comprise an outer face facing the exterior of ink cartridge 10. The outer face may comprise a front outer face 40, a rear outer face 42 opposite front outer face 40, a top outer face 41 connected to front outer face 40 and rear outer face 42, a bottom outer face 43 opposite top outer face 41 and connected to front outer face 40 and rear outer face 42, and a pair of side outer faces 44 connected to front outer face 40, rear outer face 42, top outer face 41, and bottom outer face 43.

Detection portion 39 may be configured, such that an amount of ink within ink chamber 11 may be detected through detection portion 39, e.g., visually or optically detected. Detection portion 39 may be positioned at front outer face 40 of case 20. Detection portion 39 may be positioned substantially at a middle portion of front outer face 40 with respect to height direction 26, and may extend toward the exterior of the ink cartridge away from ink chamber 11. Case 20 may integrally comprise detection portion 39, and therefore, detection portion 39 may comprise the same resin material as case 20.

Ink cartridge 10 may comprise an opaque case enclosing case 20 except for detection portion 39. Alternatively, ink cartridge 10 may comprise an opaque film connected to and/or covering case 20 except for detection portion 39. In another embodiment, case 20 may comprise a rigid frame comprising substantially a rectangular perimeter extending along front outer face 40, top outer face 41, rear outer face 42, bottom outer face 43, forming a pair of openings formed at both ends in width direction 27, respectively, and a pair of films may be connected to the frame to cover the pair of openings, respectively. In yet another embodiment, case 20 may comprise a rigid frame having a bottomed box shape with front outer face 40, top outer face 41, rear outer face 42, bottom outer face 43, and one outer side face 44, forming an opening formed at one end in width direction 27 opposite one outer side face 44, and a film may be connected to the frame to cover the opening.

Detection portion 39 may have an inner space 46 formed therein, and inner space 46 may be configured to be in fluid communication with ink chamber 11. Pivotable member 60 may be positioned within case 20, and may be used for determining whether ink chamber 11 has a sufficient amount of ink therein. Pivotable member 60 may comprise a opaque resin material, and may comprise a bar portion 63, an indicator portion 62 positioned at one end of bar portion 63, and a float portion 64 positioned at the other end of bar portion 63. The bar portion 63 may extend from indicator portion 62 to float portion 64 in a plane which is substantially parallel to height direction 26 and depth direction 25. Indicator portion 62 may be positioned within inner space 46 of detection portion 39.

Bar portion 63 may comprise a shaft 61 between indicator portion 62 and float portion 64, and shaft 61 may extend in width direction 27. Case 20 may comprise a pair of side walls having pair of side outer faces 44, and case 20 may comprise bearings (not shown) positioned at inner faces of the pair of side walls, respectively. Ends of shaft 61 with respect to width direction 27 may be coupled to bearings, respectively. As such, pivotable member 60 may be supported by case 20 at the ends of shaft 61, and pivotable member 60 may selectively pivot about shaft 61 in directions indicated by arrows 23 and 24, respectively.

Bar portion 63 and indicator portion 62 may be a thin plate, i.e., a width of bar portion 63 and indicator portion 62 in width direction 27 may be relatively small compared to the other dimensions of bar portion 63 and indicator portion 62.

Float portion 64 may have a hollow shape. The specific gravity of float portion 64 may be less than the specific gravity of ink with in ink chamber 11, such that float portion 64 floats on ink. Moreover, the specific gravity of a portion of pivotable member 60 between shaft 61 and float portion 61 may be less than the specific gravity of ink within ink chamber 11.

When pivotable member 60 pivots in the direction indicated by arrow 23, indicator portion 62 may be positioned in a lower position, as indicated by solid line in FIG. 2(B), in which indicator portion 62 contacts a bottom wall 47 of detection portion 39 which defines the bottom end of inner space 46. When pivotable member 60 pivots in the direction indicated by arrow 24, float portion 64 may contact the lower end of ink chamber 11, such that indicator potion 62 is positioned in an upper position, as indicated by a broken line in FIG. 2(B) in which indicator potion 62 is separated from bottom wall 47, and a portion of indicator portion 62 is positioned out of inner space 46.

Figure 4:
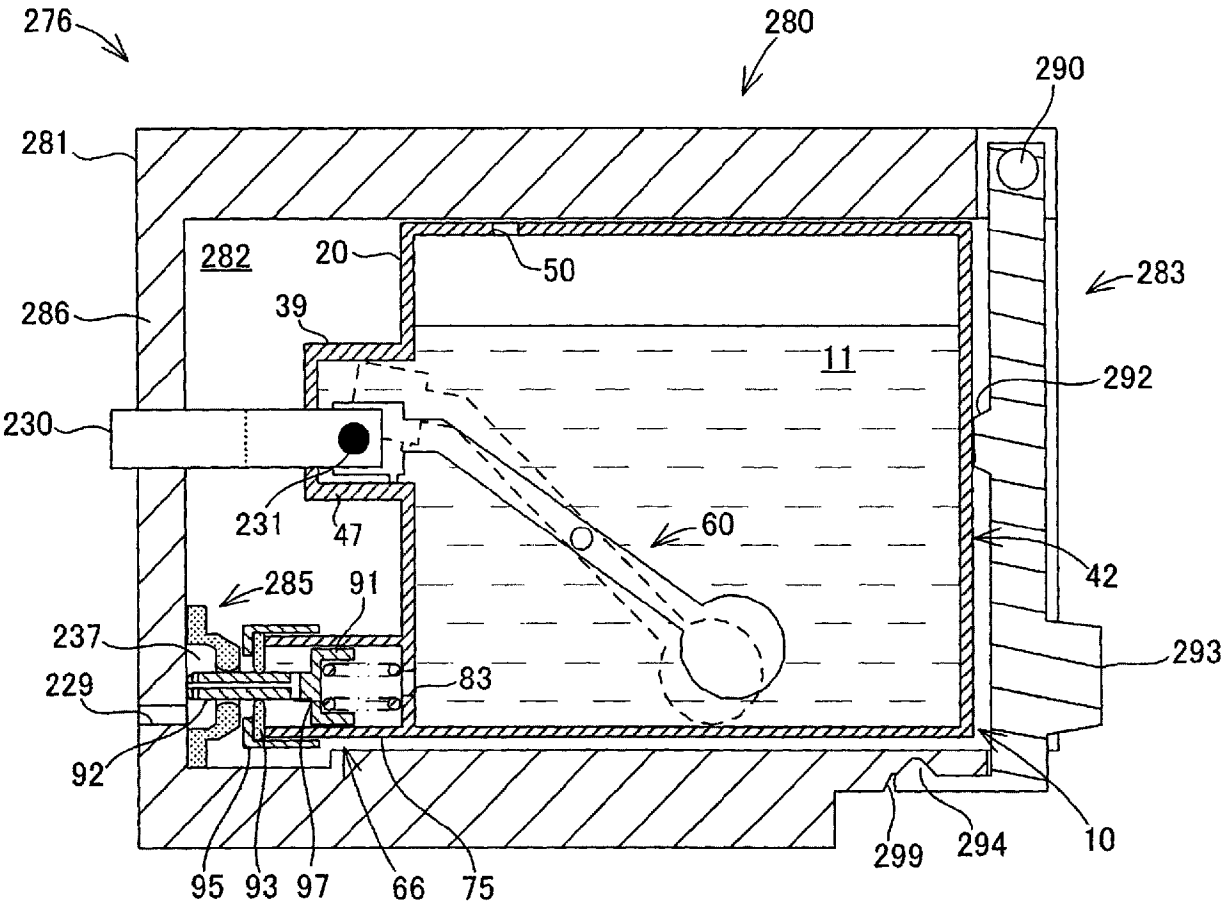
FIG. 4 is a cross-sectional, side view of the cartridge mounting portion and the ink cartridge of FIG. 3, in which the ink cartridge is positioned in the case of the cartridge mounting portion.

In this embodiment, the mass of a first portion of pivotable member 60 extending from shaft 61 to float portion 64 may be greater than the mass of a second portion of pivotable member 60 extending from shaft 61 to indicator portion 62. Therefore, the weight of the first portion of pivotable member 60 may be greater than the weight of second portion of pivotable member 60 when the entirety of the first portion and the entirety of the second portion of pivotable member 60 are in the same medium. When ink chamber 11 has a sufficient amount of ink therein, and the entirely of float portion 64 is submerged in ink, the buoyancy acting on float portion 64 may be great enough for pivotable member 60 to pivot in the direction indicated by arrow 23. As a result, indicator portion 62 may be positioned in the lower portion. In contrast, when the amount of ink within ink chamber 11 decreases and reaches a predetermined amount of ink, and at least a portion of float portion 64 is exposed above the ink surface, the gravitational force and the buoyancy acting on pivotable member 60 may balance out each other. When the amount of ink within ink chamber 11 further decreases, float portion 64 may follow the ink surface as the ink surface is lowered, such that pivotable member 60 pivots in the direction indicated by arrow 24. When the amount of ink within ink chamber 11 further decreases, float portion 64 may contact the bottom end of ink chamber 11, such that indicator potion 62 is positioned in the upper position. Indicator potion 62 may not be configured, such that the entirety of indicator portion 62 moves out of inner space 46. Referring to FIG. 4, indicator portion 62 may move to selectively enter and move out of an optical path 231 of an optical sensor 230 of recording apparatus 250.

Referring again to FIGS. 2(A) and 2(B), a wall of case 20 may have an air introduction opening 50 formed therethrough, the wall of case 20 having top outer face 41, and air may be introduced from the exterior of ink cartridge 10 to the interior of the ink storing portion via air introduction opening 50. Air introduction opening 50 may be positioned closer to front outer face 40 than to rear outer face 42. Ink chamber 11 may be configured to be in fluid communication with the exterior of ink cartridge 10 via air introduction opening 50, such that the pressure inside ink chamber 11 is equal to the atmospheric pressure independent of how much ink is in ink chamber 11. Before ink cartridge 10 is used, a sticker may be connected to top outer face 41 to cover air introduction opening 50. When a user intends to use ink cartridge 10, the user removes the sticker from to outer face 41 to bring ink chamber 11 into fluid communication with the exterior ink cartridge 10.

Figure 5A:
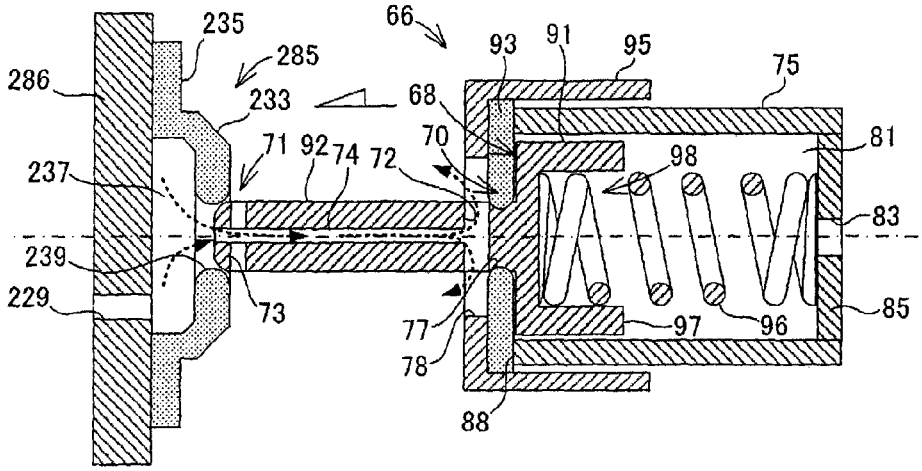
FIGS. 5(A)-5(C) are cross-sectional, side views of a valve mechanism of the ink cartridge of FIG. 3 and a connecting portion of the cartridge mounting portion of FIG. 3, in which an end of a pipe of the valve mechanism reaches an opening of the connecting portion in FIG. 5(A), the end of pipe reaches an end wall of the cartridge mounting portion in FIG. 5(B), and a coil spring of the valve mechanism contracts in FIG. 5(C).

Referring to FIG. 2(B) and FIG. 5(A), front outer face 40 may have a first end and a second end opposite the first end with respect to height direction 26, and valve mechanism 66 may be positioned adjacent to the second end of front outer face 40, such that valve mechanism 66 is positioned below detection portion 39 when ink cartridge 10 is mounted to recording apparatus 250. Valve mechanism 60 may comprise a cylindrical wall 75, a valve body 97, a biasing member, e.g., a coil spring 96, a sealing member 93, and a cap 95.

Cylindrical wall 75 may be integral with case 20, and therefore, may comprise the same translucent material as case 20. Cylindrical wall 75 may extend from front outer face 40 toward the exterior of ink cartridge 10 away from ink chamber 11 in a direction substantially perpendicular to front outer face 40, i.e., in depth direction 25. Cylindrical wall 75 may be positioned at the lower end of front outer face 40 when ink cartridge 10 is mounted to recording apparatus 250.

Cylindrical wall 75 may define at least a portion of valve chamber 81 therein. The rear end of valve chamber 81 is defined by a predetermined portion of a front wall 85 of case 20, the front wall 85 having front outer face 40. The predetermined portion of front wall 85 may have a passage 83 formed therethrough in depth direction 25, such that valve chamber 81 is in fluid communication with ink chamber 11.

The front end of cylindrical wall 75 may have an opening 88 formed therethrough, and the diameter of opening 88 may be equal to the diameter of the cross section of valve chamber 81 taken in a plane which is parallel to height direction 26 and width direction 27. Ink cartridge 10 may comprise a particular wall defining a front end of valve chamber 81. The particular wall may comprise sealing member 93 positioned at the front end of cylindrical wall 75 surrounding opening 88. Sealing member 93 may have a circular plate shape having a circular passage 77 formed therethrough, and may comprise an elastic material, such as silicon. The outer diameter of sealing member 93 may be equal to the outer diameter of cylindrical wall 75.

Cap 95 may have a cylindrical shape comprising a circular bottom wall and a peripheral wall extending from the outer edge of the circular bottom wall. The inner diameter of the peripheral wall of cap 95 may be slightly greater than the outer diameter of cylindrical wall 75. Cap 95 may be connected to cylindrical wall 75, such that the peripheral wall of cap 95 covers a front portion of cylindrical wall 75 and the circular bottom wall of cap 95 at least partially covers the opening 88, with sealing member 93 sandwiched between cap 95 and cylindrical wall 75 in a liquid tight manner, i.e., in a manner in which liquid may not pass between sealing member 93 and cylindrical wall 75 and may not pass between sealing member 93 and cap 95.

The circular bottom wall of cap 95 may have a circular opening 78 formed therethrough. Valve chamber 81 may have a central axis extending in depth direction 25 and in a direction substantially perpendicular to front outer face 40. The central axis of valve chamber 81 may intersect passage 77 of sealing member 93 and opening 78 of cap 95. Moreover, the central axis of valve chamber 81 may intersect a center of passage 77 of sealing member 93 and a center of opening 78 of cap 95. The diameter of opening 78 of cap 95 may be greater than the diameter of passage 77 of sealing member 93. Valve chamber 81 may be configured to be in fluid communication with the exterior of ink cartridge 10 via passage 77 of sealing member 93 and opening 78 of cap 95.

Valve body 97 may be positioned in valve chamber 81, and may be configured to move between a first position and a second position in depth direction 25 along the central axis of valve chamber 81. Valve body 97 may comprise a moving body, e.g., a piston 91, positioned within valve chamber 81, and a cylindrical pipe 92 extending from piston 91 in depth direction 25 along the central axis of valve chamber 81 and in a direction substantially perpendicular to front outer face 40. Piston 91 may be configured to contact sealing member 93 to cover passage 77 when valve body 97 is in the first position, and to be separated from sealing member 93 to uncover passage 77 when valve body 97 is in the second position. The diameter of opening 78 of cap 95 may be greater than the outer diameter of pipe 92. The diameter of passage 77 of sealing member 93 may be slightly less than the outer diameter of pipe 92 when pipe 92 is not positioned in passage 77 of sealing member 93 before ink cartridge 10 is assembled.

Piston 91 may comprise a circular bottom wall 68 configured to contact sealing member 93, and a peripheral wall extending from the outer edge of circular bottom wall 68. Pipe 92 may extend from circular bottom wall 68 in depth direction 25 along the central axis of valve chamber 81 away from peripheral wall of piston 91. Pipe 92 may comprise a base 70 connected to the center of circular bottom wall 68, and an end 71 opposite base 70. Pipe 92 may be positioned in passage 77 of sealing member 93 and opening 78 of cap 95 independent of the position of valve body 97, such that end 71 is positioned outside of ink cartridge 10 independent of the position of valve body 97.

Because the diameter of passage 77 of sealing member 93 may be slightly less than the outer diameter of pipe 92 when pipe 92 is not positioned in passage 77 of sealing member 93 before ink cartridge 10 is assembled, when pipe 92 is positioned in passage 77 of sealing member 93 after ink cartridge 10 is assembled, pipe 92 may expand the diameter of passage 77 and sealing member 93 may contact the outer periphery of pipe 92 in a liquid tight manner, i.e., in a manner in which liquid may not pass between sealing member 93 and the outer periphery of pipe 92. When valve body 97 moves in valve chamber 81, sealing member 93 may continue to contact the outer periphery of pipe 92, such that pipe 92 may slide on sealing member 93 in a liquid tight manner.

Pipe 92 may have an axial dimension in an axial direction extending from base 70 to end 71, and a radial dimension in a radial direction extending in a direction perpendicular to the axial direction. The axial direction may be parallel to depth direction 25 and to the central axis of valve chamber 81, and may be substantially perpendicular to front outer face 40. Pipe 92 may have a passage 72 and a passage 73 formed therethrough in the radial direction. Passage 72 may be positioned adjacent to base 70 and to piston 91, and passage 73 may be positioned adjacent to end 71.

Pipe 92 may have an inner passage 74 formed therethrough in the axial direction from end 71 toward base 70. Inner passage 74 may be continuous with passage 73 at a position adjacent to end 71, and continuous with passage 72 at a position adjacent to base 70, such that passage 72, passage 73, and inner passage 74 are configured to be in fluid communication with each other. In this embodiment, passage 72 and passage 73 may penetrate through pipe 92 in the radial direction from a first portion of the outer periphery of pipe 92 to a second portion of the outer periphery of pipe 92. Nevertheless, in another embodiment, at least one of passage 72 and passage 73 may extend from a portion of the outer periphery of pipe 92 to inner passage 74.

Circular bottom wall 68 and the peripheral wall of valve body 97 may define a recess 98 therein. Coil spring 96 may be positioned between recess 98 and front wall 85 while coil spring 96 is compressed, and a portion of coil spring 96 is positioned within recess 98. Coil spring 96 may apply a biasing force to piston 91 toward passage 77 of sealing member 93. When valve body 97 is positioned in the first position, as shown in FIG. 5(A), in which circular bottom wall 68 contacts sealing member 93 with piston 91 biased toward passage 77 of sealing member 93, passage 77 of sealing member 93 may be positioned between passage 72 and valve chamber 81, and sealing member 93 may contact the outer periphery of pipe 92 in a liquid tight manner such that liquid may not leak from valve chamber 81 to the exterior of ink cartridge 10 via passage 77 of sealing member 93.

When an external force is applied to valve body 97 toward valve chamber 81 against the biasing force of coil spring 96, a portion of pipe 92 adjacent to base 70 may enter valve chamber 81, and circular bottom wall 68 may separate from sealing member 93 and from passage 77 of sealing member 93. When valve body 97 is positioned in the second position, as shown in FIG. 5(C), passage 72 may be positioned within valve chamber 81. When passage 72 is positioned within valve chamber 81, valve chamber 81 may be in fluid communication with the exterior of ink cartridge 10 via passage 72, inner passage 74, and passage 73 although sealing member 93 contacts the outer periphery of pipe 92 in a liquid tight manner Referring to FIGS. 3 and 4, cartridge mounting portion 276 is depicted. Case 280 may comprise a case main body 281 and a lock lever 283. Case 281 may have an accommodating chamber 282 defined therein. Accommodating chamber 282 may be configured to accommodate ink cartridge 10 therein. Case main body 281 may have an opening 284 formed therethrough, and ink cartridge 10 may be configured to be inserted into and removed from case main body 281 via opening 284.

Case main body 281 may comprise an end wall 286 opposite opening 284. Ink cartridge may be configured to be inserted into case main body 281 from opening 284 toward end wall 286 in an insertion direction. When ink cartridge 10 is mounted to case 280, front outer face 40 of ink cartridge 10 may face end wall 286. Optical sensor 230 may be positioned at end wall 286. Optical sensor 230 may be configured to detect indicator portion 62. In this embodiment, optical sensor 230 may comprise a light emitting device and a light receiving device facing each other, and an optical path 231 is formed between the light emitting device and the light receiving device. When ink cartridge 10 is mounted to case 280, detection portion 39 may be positioned between the light emitting device and the light receiving device of optical sensor 230. When indicator portion 62 is positioned in the lower position, indicator potion 62 may be positioned in optical path 231, and indicator portion 62 may block the light of optical sensor 230, such that the light does not reach the light receiving device. When indicator potion 62 is in the upper position, indicator portion 62 may be out of optical path 231, such that the light reaches the light receiving device. Whether ink chamber 11 has a sufficient amount of ink therein may be determined based on whether light receiving device receives the light from the light emitting portion.

Case 280 may comprise a connecting portion 285 positioned at end wall 286 below optical sensor 230. Connecting portion 285 may extend from end wall 286 toward accommodating chamber 282. When ink cartridge 10 is mounted to case 280, pipe 92 of valve mechanism 66 of ink cartridge 10 may be connected to connecting portion 285, such that connecting portion 285 receives ink supplied from ink cartridge 10.

End wall 286 may have a passage 229 formed therethrough, and flexible tube 278 may be connected to passage 229. Connecting portion 285 may be in fluid communication with flexible tube via passage 229. Therefore, when pipe 92 of valve mechanism 66 is connected to connecting portion 285, a path of ink may be formed from connecting portion 285 to a recoding head 272 via passage 229 and flexible tube 278.

Lock lever 283 may be configured to pivot, such that lock lever 283 selectively covers and uncovers opening 284. Lock lever 283 also may be configured to retain ink cartridge 10 positioned in accommodating chamber 282. Case 280 may comprise a shaft 290 positioned directly above opening 284, and a first end of lock lever 283 may be coupled to shaft 290, such that lock lever 283 pivots about shaft 290. Lock lever 290 may have an inner surface 296 and an outer surface 297 opposite inner surface 296. When lock lever 290 covers opening 24, inner surface 296 faces accommodating chamber 282. Lock lever 283 may comprise a pressing portion 292, operation portion 293, and a claw 294. Claw 294 may be positioned at inner surface 296 and at a second end of lock lever 283 opposite the first end of lock lever 283. Pressing portion 292 may be positioned at inner surface 296 at a middle position between the first end of lock lever 283 and the second end of lock lever 283, and may extend from inner surface 296. Operation portion 293 may be positioned at outer surface 297 adjacent to the second end of lock lever 283. Case 280 may have a groove 299 formed therein at a position below opening 284, and groove 299 may be configured to engage claw 294.

When ink cartridge 10 is positioned in accommodating chamber 282 and lock lever 283 pivots toward opening 284, pressing portion 292 may contact rear outer face 42 of ink cartridge 10. Subsequently, when a user pushes operation portion 293 toward opening 284, lock lever 283 may deform with pressing portion 292 being a fulcrum, and the second end of lock lever 283 may move toward groove 299 and claw 294 may engage groove 299, such that lock lever 283 is secured to case main body 281. After lock lever 283 is secured to case main body 281, rear outer face 42 of ink cartridge 10 may receive a force via pressing portion 292 toward end wall 286, such that ink cartridge 10 is securely retained in case 280.

Figure 5B:
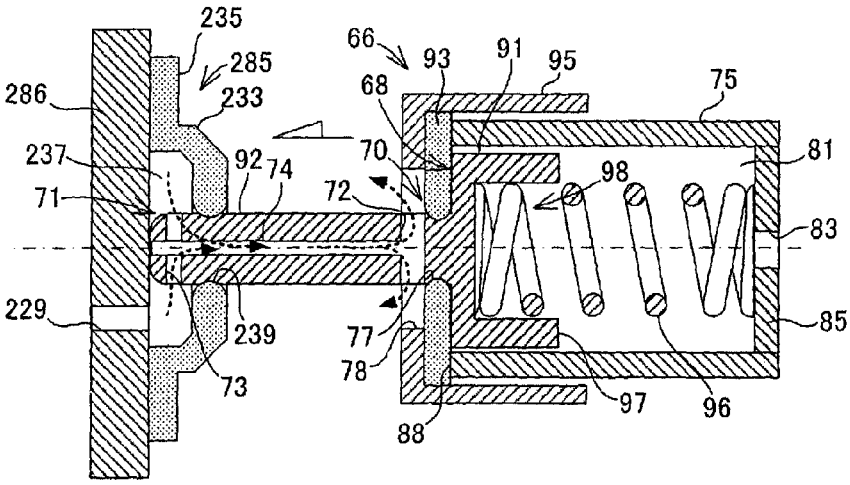
Figure 5C:
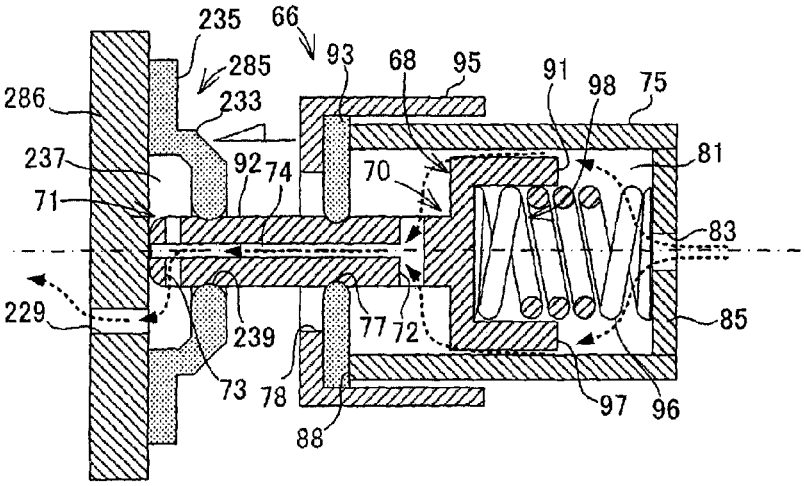

Referring to FIGS. 5(A)-(C), connecting portion 285 may comprise an elastic synthetic resin, e.g., a thermoplastic elastomer, silicon, or the like. Connecting portion 285 may comprise a bowl-shape portion 233 and a leg portion 235 connected to, e.g., adhered to, end wall 286 in a liquid tight manner, i.e., in a manner in which liquid may not pass between leg portion 235 and end wall 286. Leg portion 235 may extend from outer edge of bowl-shape portion 233. Bowl-shape portion 233 and end wall 286 may define a space 237 formed therein. Passage 229 may be continuous with space 237, such that space 237 is in fluid communication with flexible tube 278 via passage 229. In another embodiment, a connecting portion may be a recess formed in end wall 286 in which pipe 92 may be fitted.

Bowl-shape portion 233 may comprise a wall having a passage 239 formed therethrough. When ink cartridge 10 is inserted into accommodating chamber 282, pipe 92 enters passage 239, and therefore when ink cartridge 10 is positioned in accommodating chamber 282, pipe 92 may be positioned in passage 239. The diameter of passage 239 is slightly less than the outer diameter of pipe 91 before pipe 92 enters passage 239. When pipe 92 is positioned in passage 239, pipe 92 may expand the diameter of passage 239 and bowl-shape portion 233 may contact the outer periphery of pipe 92 in a liquid tight manner, i.e., in a manner in which liquid may not pass between bowl-shape portion 233 and the outer periphery of pipe 92.

When ink cartridge 10 is inserted into accommodating chamber 282 and end 71 of pipe 92 reaches passage 239, end 71 of pipe 92 may block passage 239, as shown in FIG. 5(A). Subsequently, when ink cartridge 10 is further inserted, end 71 of pipe 92 may reach end wall 286, as shown in FIG. 5(B). Until end 71 of pipe 92 initially contacts end wall 286, valve body 97 may be positioned in the first position in which coil spring 96 applies a biasing force to circular bottom wall 68 of piston 91, such that circular bottom wall 68 contacts sealing member 93.

Until end 71 of pipe 92 reaches end wall 286 after end 71 of pipe 92 blocks passage 239, pipe 92 may push away air and/or ink disposed in space 237. The air and/or ink pushed away may enter inner passage 74 via end 71 of pipe 92. Subsequently, the air and/or ink may escape via passage 72 to the exterior of pipe 92, as depicted by broken arrows in FIGS. 5(A) and 5(B). Therefore, ink disposed in the path of ink extending from connecting portion 285 to recoding head 272 via passage 229 and flexible tube 278 may not be compressed by the air and/or ink pushed away by pipe 92. The pressure in the path of ink may be prevented from increasing.

When end 71 of pipe 92 contacts end wall 286, the movement of pipe 92 toward end wall 286 may be prevented by end wall 286. Subsequently, when ink cartridge 10 is further inserted toward end wall 286, coil spring 96 may contract, such that valve body 97 moves with respect to cylindrical wall 75 toward opening 284. Therefore, valve body 97 may move toward front wall 85 against the biasing force of coil spring 96 while case 20 moves toward end wall 286. When valve body 97 moves to the second position, as shown in FIG. 5(C), passage 72 of pipe 92 passes through sealing member 93 and enters valve chamber 81. When this occurs, a path of ink is formed from ink chamber 11 to recording head 272 via passage 83, valve chamber 81, passage 72, inner passage 74, passage 73, space 237, passage 229, and flexible tube 278, as depicted by broken arrows in FIG. 5(C).

As described above, because ink cartridge 10 comprises pipe 92, even if pipe 92 is damaged, a user may use recording apparatus 250 with a new ink cartridge 10.

Figure 6A:
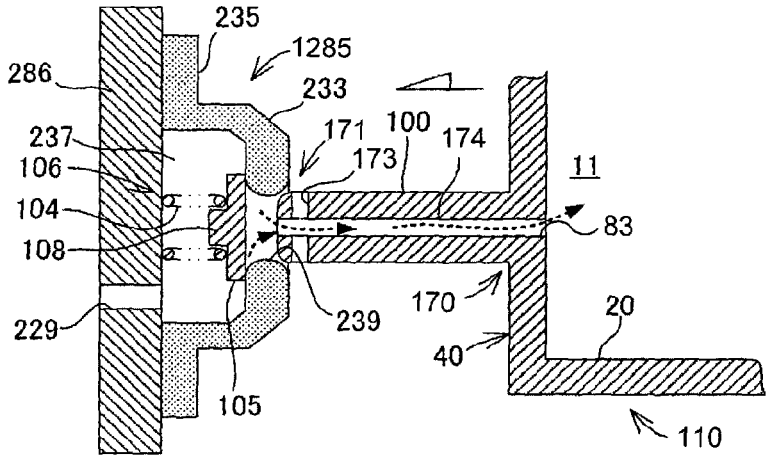
FIGS. 6(A)-6(C) are cross-sectional, side views of a portion of an ink cartridge and a connecting portion, according to another embodiment of the present invention, in which an end of a pipe of the ink cartridge reaches an opening of the connecting portion in FIG. 6(A), the end of pipe reaches a valve body of the connecting portion in FIG. 6(B), and a coil spring of the connecting portion contracts in FIG. 6(C).
Figure 6B:
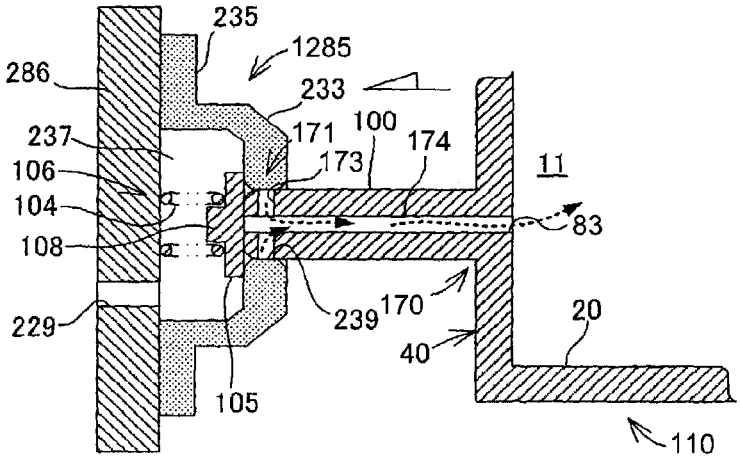
Figure 6C:
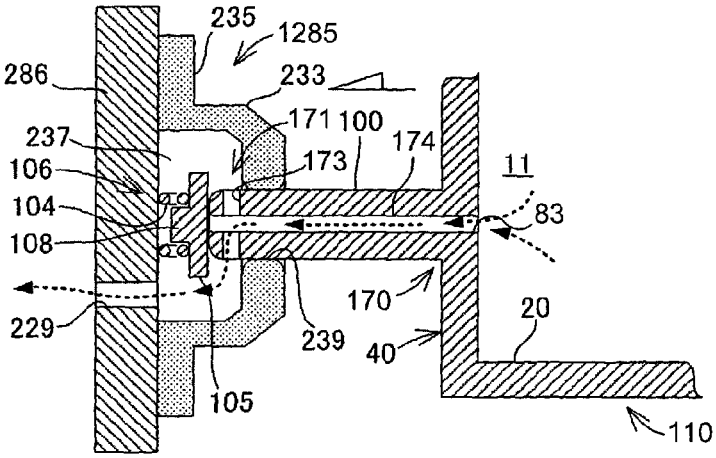

Referring to FIGS. 6(A) to 6(C), an ink supply system according to another embodiment of the present invention is depicted. The ink supply system according to this embodiment may comprise an ink cartridge 110 and a connecting portion 1285. Ink cartridge 110 may not comprise valve mechanism 66. Ink cartridge 110 may comprise a pipe 100 extending from front outer face 40 toward the exterior of ink cartridge 110 away from ink chamber 11 in a direction substantially perpendicular to front outer face 40, i.e., in depth direction 25. Pipe 100 may comprise a base 170 connected to front outer face 40, and an end 171 opposite base 170. Pipe 100 may have an axial dimension in an axial direction extending from base 170 to end 171, and a radial dimension in a radial direction extending in a direction perpendicular to the axial direction. The axial direction may be parallel to depth direction 25 and substantially perpendicular to front outer face 40. Pipe 100 may have an inner passage 174 formed therethrough in the axial direction from end 171 to base 170, and an passage 173 formed therethrough in the radial direction adjacent to end 171. Passage 173 may be continuous with inner passage 174 such that passage 173 is in fluid communication with inner passage 174. Inner passage 174 may be continuous with passage 83 such that inner passage 174 is in fluid communication with passage 83. Connecting portion 1285 may comprise a valve mechanism 106 in addition to bowl-shape portion 233 and leg portion 235. Valve mechanism 106 may be positioned in space 237 and may comprise a valve body 105 and a biasing member, e.g., a coil spring 104. Valve body 105 may be configured to move between a third position in which valve body 105 contacts bowl-shape portion 233 to cover passage 239 from space 237, and a fourth position in which valve body 105 is separated from bowl-shape portion 233 to uncover passage 239. Coil spring 104 may be positioned between valve body 105 and end wall 286. Valve body 105 may comprise a spring seat 108 extending toward end wall 286. One end of coil spring 104 may be connected to spring seat 108, and the other end of coil spring 104 may contact end wall 286.

When ink cartridge 110 is inserted into accommodating chamber 282 and end 171 of pipe 100 reaches passage 239, end 171 of pipe 100 may block passage 239 as shown in FIG. 6(A). Subsequently, when ink cartridge 110 is further inserted, end 171 of pipe 100 may reach valve body 105 as shown in FIG. 6(B). Until end 171 of pipe 100 initially contacts valve body 105, valve body 105 may be positioned in the third position while valve body 105 being biased toward passage 239 by coil spring 104.

Until end 171 of pipe 100 reaches valve body 105 after end 171 of pipe 100 blocks passage 239, pipe 100 may push away air and/or ink disposed in passage 239. The air and/or ink pushed away may enter inner passage 174 via end 171 of pipe 100. Subsequently, the air and/or ink may escape into ink chamber 11, as depicted by broken arrows in FIGS. 6(A) and 6(B). Therefore, ink disposed in a path of ink extending from connecting portion 1285 to recoding head 272 via passage 229 and flexible tube 278 may not be compressed by the air and/or ink pushed away by pipe 100. The pressure in the path of ink may be prevented from increasing.

When ink cartridge 110 is further inserted into accommodating chamber 282, end 171 of pipe 100 pushes valve body 105 toward end wall 286 against a biasing force of coil spring 104, such that valve body 105 separates from passage 239 and passage 239 is uncovered. As such, a path of ink extending from ink chamber 11 to recording head 272 via passage 83, inner passage 174, passage 173, space 237, passage 229, and ink tube 278 is formed, as depicted by broken arrows in FIG. 6(C).

A sticker may be adhered to pipe 100 to cover an end of inner passage 174 at end 171 and to cover opening 173 via a thermal adhesion method, for example. When a user intends to use ink cartridge 100, the user removes sticker from pipe 100.

Figure 7:
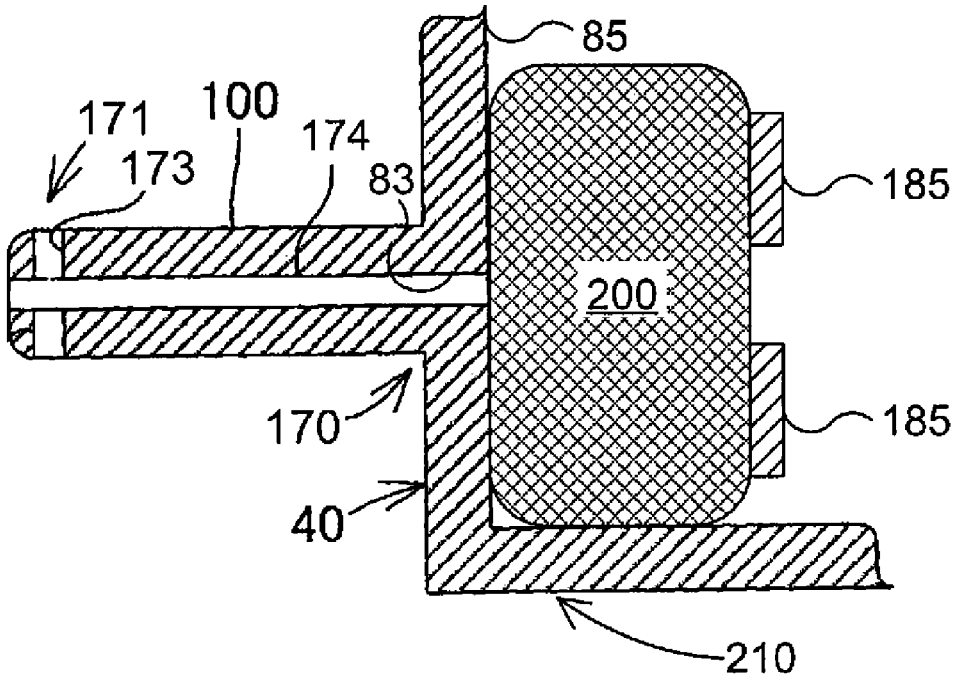
FIG. 7 is a cross-sectional, side view of a portion of an ink cartridge, according to yet another embodiment of the present invention.

Referring to FIG. 7, an ink cartridge 210 according to yet another embodiment is depicted. Ink cartridge 210 may comprise an absorbing member 200, e.g., a sponge, cotton, or the like, which is positioned in ink chamber 11 adjacent to passage 83. For example, the absorbing member 200 may cover passage 83. Ink cartridge 210 also may comprise at least one, e.g., two, inner walls 185 positioned within ink chamber 11, and absorbing member 200 may be sandwiched by front wall 85 and inner walls 185. Because absorbing member 200 is configured to absorb ink, ink may not leak from ink cartridge 210 even when a valve mechanism is not present in ink cartridge 210.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

The invention claimed is:

1. An ink cartridge, comprising:

an ink storing portion configured to store ink therein, the ink storing portion comprising:

an ink chamber configured to store a first predetermined amount of the ink therein; and a valve chamber configured to store a second predetermined amount of ink therein, which is less than the first predetermined amount of ink, wherein a particular wall defines at least a portion of the valve chamber, and the pipe extends from an interior of the valve chamber to an exterior of the valve chamber via a particular passage, wherein the pipe has an outer periphery and a further passage formed therein, and the further passage extends from the outer periphery to the inner passage;

the particular wall defining at least a portion of the ink storing portion, wherein the particular wall has the particular passage formed therethrough;

a pipe extending from an interior of the ink storing portion to an exterior of the ink storing portion via the particular passage, wherein the pipe has an inner passage formed therethrough, and the inner passage is configured to transmit ink from the interior of the ink storing portion to the exterior of the ink storing portion;

a valve body comprising a moving body positioned within the valve chamber, wherein the pipe extends from the moving body, and the valve body is configured to move between a first position in which the moving body covers the particular passage and a second position in which the moving body is separated from the particular passage; and a biasing member configured to apply a biasing force to the moving body toward the particular passage, wherein when the valve body is in the first position, the particular passage is positioned between the further passage and the valve chamber, and when the valve body is in the second position, the further passage is positioned within the valve chamber.

2. The ink cartridge of claim 1, further comprising an air introduction portion configured to introduce air from the exterior of the ink storing portion to the interior of the ink storing portion.

3. The ink cartridge of claim 1, wherein the further passage is positioned adjacent to the moving body.

4. The ink cartridge of claim 1, wherein the particular wall comprises a sealing member, wherein the sealing member comprises an elastic material and has the particular passage formed therethrough, and the sealing member is configured to contact the outer periphery of the pipe positioned in the particular passage.

5. An ink supply system configured to supply ink to a recording head, comprising:

a connecting portion configured to be in fluid communication with the recording head;

an ink cartridge comprising:

an ink storing portion configured to store ink therein, wherein the ink storing portion comprises:

an ink chamber configured to store a first predetermined amount of the ink therein; and a valve chamber configured to store a second predetermined amount of ink therein, which is less than the first predetermined amount of ink;

a particular wall defining at least a portion of the valve chamber, wherein the particular wall has a particular passage formed therethrough;

a valve body comprising:

a moving body positioned within the valve chamber; and a pipe extending from the moving body, wherein the pipe extends from an interior of the valve chamber to an exterior of the valve chamber via the particular passage, and the pipe is configured to be removably connected to the connecting portion, wherein the pipe has an inner passage formed therethrough, and ink is supplied from the interior of the valve chamber to the connecting portion via the inner passage of the pipe when the pipe is connected to the connecting portion, wherein the pipe has an outer periphery and a further passage formed therein, and the further passage extends from the outer periphery to the inner passage, wherein the valve body is configured to move between a first position in which the particular passage is positioned between the further passage and the valve chamber, and a second position in which the further passage is positioned within the valve chamber; and a biasing member configured to apply a biasing force to the moving body to position the valve body in the first position, wherein the valve body is configured to move from the first position to the second position against the biasing force when the pipe is connected to the connecting portion.

6. An ink supply system configured to supply ink to a recording head, comprising:

an ink cartridge, comprising:

an ink storing portion configured to store ink therein;

a particular wall defining at least a portion of the ink storing portion, wherein the particular wall has a particular passage formed therethrough; and a pipe extending from the particular wall away from the ink storing portion, wherein the pipe has an inner passage formed therethrough, and the inner passage is continuous with the particular passage; and a connecting portion configured to be in fluid communication with the recording head, wherein the pipe is configured to be removably connected to the connecting portion, and the connecting portion comprises:

a further wall defining at least a portion of a space therein, wherein the further wall has a further passage formed therethrough;

a valve body which is positioned in the space and is configured to move between a first position in which the valve body covers the further passage and a second position in which the valve body is separated from the further passage; and a biasing member configured to apply a biasing force to the valve body to position the valve body in the first position, wherein the valve body is configured to move from the first position to the second position against the biasing force when the pipe is connected to the connecting portion to supply ink from an interior of the ink storing portion to the connecting portion.

7. The ink supply system of claim 6, wherein the ink cartridge further comprises an absorbing member configured to absorb ink, wherein the absorbing member is positioned within the ink storing portion and adjacent to the particular passage.

* * * * *